United States Patent [19]

Deutsch

[11] 3,972,259

[45] Aug. 3, 1976

[54] PRODUCTION OF PULSE WIDTH MODULATION TONAL EFFECTS IN A COMPUTOR ORGAN

[75] Inventor: Ralph Deutsch, Sherman Oaks, Calif.

[73] Assignee: Nippon Gakki Seizo Kabushiki Kaisha, Hamamatsu, Japan

[22] Filed: Sept. 26, 1974

[21] Appl. No.: 509,705

[52] U.S. Cl. ..... 84/1.24; 235/152; 235/197

[51] Int. Cl.[2] ..... G10H 1/02; G10H 5/02

[58] Field of Search ..... 84/1.01, 1.22–1.25; 235/152, 197

[56] References Cited

UNITED STATES PATENTS

| | | | |
|---|---|---|---|
| 3,610,799 | 10/1971 | Watson | 84/1.01 |
| 3,809,786 | 5/1974 | Deutsch | 84/1.01 |
| 3,809,788 | 5/1974 | Deutsch | 84/1.01 |
| 3,809,789 | 5/1974 | Deutsch | 84/1.01 |
| 3,809,790 | 5/1974 | Deutsch | 84/1.01 |
| 3,821,714 | 6/1974 | Tomisawa et al. | 84/1.01 X |
| 3,823,390 | 7/1974 | Tomisawa et al. | 84/1.01 X |

OTHER PUBLICATIONS

James W. Beauchamp et al., "A Computer System for Time–Variant Harmonic Analysis and Synthesis of Musical Tones", Music by Computers, John Wiley and Sons, Inc., C. 1969, pp. 19–62.

*Primary Examiner*—L. T. Hix
*Assistant Examiner*—Stanley J. Witkowski
*Attorney, Agent, or Firm*—Howard A. Silber

[57] ABSTRACT

In a computor organ, musical tones are generated by separately evaluating the constituent Fourier components of a musical waveshape and summing these to obtain the waveshape sample point amplitudes. The relative amplitude contribution of each Fourier component is established by a harmonic coefficient. In accordance with the present invention, pulse-type tone generation is simulated by using harmonic coefficient values associated with the frequency spectrum of a pulse train of particular pulse shape. For example, the coefficients may be given by the Fourier transform associated with repetitive pulses.

To simulate pulse width modulation effects, a set of such coefficients is stored in a memory, the set having more coefficients than the maximum number of Fourier components included in each amplitude computation. Pulse trains of different pulse width are simulated by utilizing different subsets of the stored coefficients in the amplitude computation. Pulse width modulation tonal effects are achieved by changing the selected subsets as a function of time.

11 Claims, 5 Drawing Figures

PRODUCTION OF PULSE WIDTH MODULATION TONAL EFFECTS IN A COMPUTOR ORGAN

BACKGROUND OF THE INVENTION

1. Field of the Invention

The present invention relates to the production of pulse width modulation tonal effects in a computor organ.

2. Description of the Prior Art

The inventor's U.S. Pat. No. 3,809,786 entitled COMPUTOR ORGAN discloses an electronic musical instrument in which tones are synthesized by separately evaluating the individual Fourier components that comprise a musical waveshape. These are summed to obtain in real time the waveshape amplitudes at successive sample points. In other words, the computor organ generates tones in the frequency domain, allocating separate time slots for evaluation of the constituent frequency components of the tone.

In contrast, an analog tone generator operates basically in the time domain. For example, such an analog instrument may produce a pulse train in which the pulse repetition rate establishes the fundamental frequency $f$ of the produced note, and wherein the pulse shape and duty cycle determine the frequency spectral content of the tone.

This is illustrated in FIG. 1 for the case of an analog tone generator which produces rectangular pulses at a repetition rate or fundamental frequency $f$. As is known, the spectral content of such a rectangular wave is obtained by Fourier transform, where the Fourier or harmonic coefficients are given by:

$$C_m = A \frac{\tau}{T} \frac{\sin \pi m(\tau/T)}{\pi m(\tau/T)} \qquad \text{(Equation 1)}$$

where $\tau$ is the width of each pulse, $T=1/f$ is the pulse repetition period, A is the amplitude of the pulse and $C_m$ is the amplitude of the $m^{th}$ order harmonic component. The spectrum will have its zero points at harmonics:

$$m=k(T/\tau) \qquad \text{(Equation 2)}$$

where $k=1,2,3, \ldots$

A typical harmonic spectrum for the rectangular pulse train of FIG. 1 is shown in FIG. 2. In this example, the first zero $f_{c1}$ is at $m=16$ for the case where the nominal pulse width $\tau_0=T/16$. For equations 1 and 2 it is assumed that the pulse width $\tau \leq (T/2)$.

If the pulse width $\tau$ is increased to a value $\tau>\tau_0$, the frequency of the first zero decreases from $f_{c1}$ to $f_{c2}$, as illustrated in FIG. 3 which shows the amplitude envelope of the harmonic spectrum (FIG. 2) defined by equation 1. Conversely, if the pulse width $\tau$ is decreased to a value less than the nominal width $\tau_0$, the frequency of the first zero increases from $f_{c1}$ to $f_{c3}$.

In a pulse type analog tone generator, modulation effects similar to vibrato may be introduced by varying the pulse width $\tau$ at the rate (about 5Hz to 8Hz) generally used for vibrato. An object of the present invention is to simulate pulse-type tone generation, both with and without pulse width modulation effects, in a computor organ. Another object of the present invention is to implement modulation of the set of harmonic coefficients used to establish the Fourier component relative amplitudes in a computor organ.

SUMMARY OF THE INVENTION

These and other objectives are achieved in a computor organ of the type disclosed in the above mentioned U.S. Pat. No. 3,809,786 which is incorporated herein by reference. As used in this application, the term "computor organ" or "patented computor organ" refers to an instrument of the type disclosed by that patent.

To simulate pulse-type tone generation, the harmonic coefficients used by the patented computor organ in the waveshape amplitude computations are selected to correspond to the frequency transform of the pulse shape being simulated. For example, if a tone characteristic of a rectangular pulse train (FIG. 1) is to be simulated, the harmonic coefficients defined by equation 1 and illustrated in FIG. 2 would be used to compute the constituent Fourier components of the musical waveshape.

Pulse-width modulation effects are achieved by storing a set of harmonic coefficients, defined by equation 1, but extending to an order $m$ greater than the maximum number W of Fourier components used in the waveshape amplitude computation. A selected subset of the stored coefficients then is employed to establish relative amplitudes of the Fourier components used in the computation. Pulse width modulation tonal effects are achieved by varying this subset as a function of time. Amplitude scaling may be used to compensate for amplitude envelope changes resulting from utilization of different harmonic coefficient subsets.

BRIEF DESCRIPTION OF THE DRAWINGS

A detailed description of the invention will be made with reference to the accompanying drawings wherein like numerals designate corresponding elements in the several figures.

DESCRIPTION OF THE PREFERRED EMBODIMENTS

Figure 1:
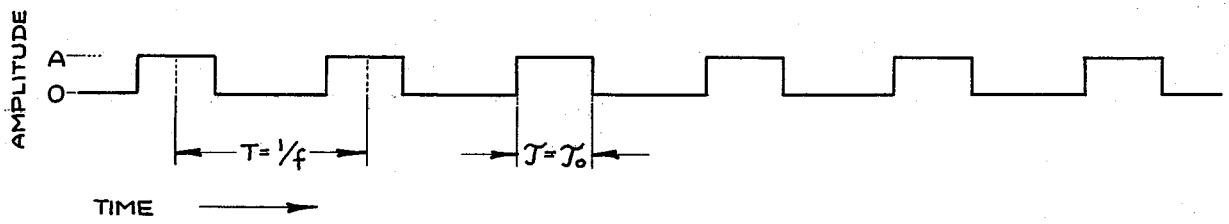
FIG. 1 illustrates a rectangular pulse train that might be generated by an analog musical instrument, the tonal quality of which is simulated by a computor organ modified in accordance with the present invention.

The following detailed description is of the best presently contemplated modes of carrying out the invention. This description is not to be taken in a limiting sense, but is made merely for the purpose of illustrating the general principles of the invention since the scope of the invention best is defined by the appended claims.

Operational characteristics attributed to forms of the invention first described also shall be attributed to forms later described, unless such characteristics obviously are inapplicable or unless specific exception is made.

In the patented computor organ, musical tones are generated by computing in real time the amplitudes at successive sample points of a musical waveshape, and converting these amplitudes to tones as the computations are carried out. The fundamental frequency of the generated tone is established by a frequency number R which is accessed from a memory 14 (FIG. 4) in response to selection of an instrument keyboard switch 12. At the beginning of each computation interval $t_x$ the frequency number R is supplied via a gate 24 to a note interval adder 25 and is added to the previous contents thereof.

Thus the contents of the adder 25, supplied via a line 26, represents the value ($q$R) designating the waveshape sample point currently being evaluated. Preferably the note interval adder 25 is of modulo 2W, where W is the highest order Fourier component evaluated by the instrument 10.

Each calculation timing pulse $t_c$ is supplied via a line 21 to a gate 27. This gate 27 provides the value $q$R to a harmonic interval adder 28 which is cleared at the end of each amplitude computation interval $t_x$. Thus the contents of the harmonic interval adder 28 is incremented by the value ($q$R) at each calculation interval $t_{cl}$ through $t_{c16}$ so that the contents of the adder 28 represents the quantity ($nq$R).

An address decoder 30 accesses from a sinusoid table 29 the value $\sin\pi/WnqR$ corresponding to the argument $nq$R received from the adder 28. The sinusoid table 29 may comprise a read only memory storing values of $\sin\pi/W\,\phi$ for $0 \leq \phi \leq W/2$ at intervals of D, where D is called the resolution constant of the memory. With this arrangement, the value $\sin\pi/WqR$ will be supplied on a line 32 during the first calculation interval $t_{cl}$. During the next interval $t_{c2}$, the value $\sin\pi/W2qR$ will be present on the line 32. Thus in general, the value $\sin\pi/WnqR$ will be provided from the sinusoid table 29 for the particular $n^{th}$ order component specified by the contents of a counter 22.

The value $\sin\pi/WnqR$ then is provided via the line 32 to a harmonic amplitude multiplier 33 where it is multiplied by a harmonic coefficient $C_n$ to obtain the constituent Fourier component amplitude $F^{(n)}$ given by:

$$F^{(n)}=C_n\sin\pi/WnqR \qquad \text{(Equation 3)}$$

where $n$=1,2,3, . . . $W$ is the order of the Fourier component being evaluated, and where $qR$ specifies the waveshape sample point for values $q$=1,2,3, . . . and where R is the frequency number mentioned above. The Fourier component amplitudes $F^{(n)}$ thus obtained are supplied via a line 34 to an accumulator such as that designated 16 in FIG. 1 of the cited COMPUTOR ORGAN patent. There the constituent Fourier components are summed to obtain each waveshape sample point amplitude. These amplitudes are gated via a digital-to-analog converter to a sound system where they are converted to musical tones.

Figure 4:
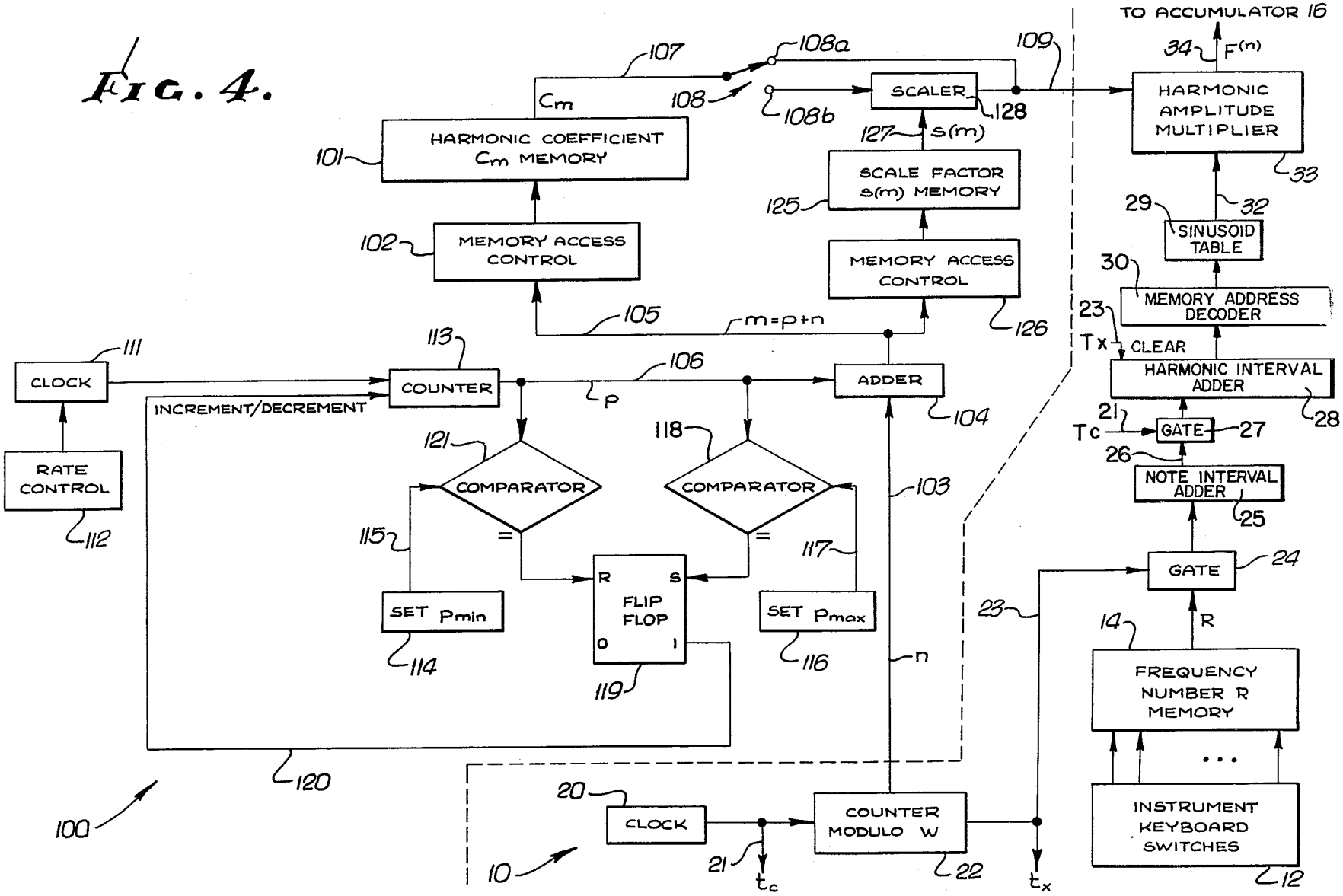
FIG. 4 is an electronic block diagram of circuitry for implementing pulse width modulation tonal effects in a computor organ.

As thus far described, operation of the computor organ 10 is as set forth in the cited patent, and the reference numerals utilized herein in FIG. 4 correspond to the like components in that patent. In accordance with the present invention, pulse width modulation tonal effects are synthesized by providing the computor organ 10 with certain pulse width modulation circuitry 100 shown in FIG. 4.

This circuitry 100 includes a harmonic coefficient memory 101 that store a set of harmonic coefficients which are characteristic of the particular pulse waveshape that is to be synthesized. For example, to simulate the tonal effects associated with a rectangular pulse train such as that of FIG. 1, the memory 101 may store a set of coefficient values $C_m$ given by equation 1 and illustrated by the spectrum of FIG. 2. Illustrative values for such coefficients $C_m$ for values of $m$ between $m$=0 and $m$=32 are set forth in the following Table I.

TABLE I

| m | $C_m$ | db Attenuation | m | $C_m$ | db Attenuation |
|---|---|---|---|---|---|
| 1 | 0.9872 | 0 | 17 | 0.0030 | 24.6 |
| 2 | 0.9496 | 0.1 | 18 | 0.0117 | 19.2 |
| 3 | 0.8895 | 0.4 | 19 | 0.0221 | 16.5 |
| 4 | 0.8105 | 0.8 | 20 | 0.0325 | 14.8 |
| 5 | 0.7173 | 1.4 | 21 | 0.0406 | 13.8 |
| 6 | 0.6149 | 2.1 | 22 | 0.0457 | 13.3 |
| 7 | 0.5092 | 2.9 | 23 | 0.0472 | 13.2 |
| 8 | 0.4053 | 3.9 | 24 | 0.0450 | 13.4 |
| 9 | 0.3080 | 5.1 | 25 | 0.0399 | 13.9 |
| 10 | 0.2214 | 6.5 | 26 | 0.0327 | 14.8 |
| 11 | 0.1482 | 8.2 | 27 | 0.0246 | 16.0 |
| 12 | 0.0900 | 10.4 | 28 | 0.0165 | 17.7 |
| 13 | 0.0474 | 13.2 | 29 | 0.0095 | 20.1 |
| 14 | 0.0193 | 17.1 | 30 | 0.0042 | 23.7 |
| 15 | 0.0040 | 23.5 | 31 | 0.0010 | 29.8 |
| 16 | 0.0000 | greater than 50 | 32 | 0.0000 | greater than 50 |

Harmonic coefficients $C_m$ are accessed from the memory 101 by a memory access control 102 in unison with calculation of the individual constituent Fourier components. The rate at which these components are calculated is established by a clock 20 which supplies calculation timing interval pulses $t_c$ on a line 21. These pulses are sent to a counter 22 of modulo W where W corresponds to the highest order Fourier component evaluated by the computor organ 10. In the illustrative embodiment described herein, $W$=16. Satisfactory tonal synthesis is achieved by utilizing sixteen constituent Fourier components.

The contents of the counter 22 correspond to the order $n$ of the Fourier component currently being evaluated. This value $n$ is supplied via a line 103, and adder 104 and a line 105 to the memory access control 102. Advantageously the value $n$ is supplied as a binary number. In that case, the harmonic coefficient memory 101 and the access control 102 both may be implemented using a conventional integrated circuit read-only memory such as the Signetics type 8223. The access control portion of this device accepts a binary-coded addressing signal such as that which may be supplied via the lines 103 and 105.

The counter 22 resets each time a count of $W$=16 is reached. At this time all of the W constituent Fourier components have been evaluated. Resetting of the counter 22 produces a computation timing pulse $t_x$ on a line 23. This $t_x$ pulse enables the gate 24, and also gates the computed waveshape amplitude from the accumulator to the digital-to-analog converter and sound system. In other words, the $t_x$ pulse indicates completion of each successive sample point amplitude computation by the computor organ 10.

As described below in greater detail, the adder 104 adds to the component order $n$ present on the line 103 a value $p$ present on a line 106 and indicative of the particular subset of harmonic coefficients to be accessed from the memory 101. When $p$=0, the order $n$ itself is supplied via the line 105. The corresponding harmonic coefficient $C_m=C_n$ is accessed from the memory 101 and supplied via a line 107, a switch 108, a switch contact 108*a* and a line 109 to the harmonic amplitude multiplier 33. In this configuration, the first sixteen ($m=1$ through $m-16$) harmonic coefficients $C_m$ from the Table I will be used in the Fourier component calculations. The resultant musical tone will sound like that of a pulse-type analog musical instrument which generates a pulse train (like FIG. 1) of constant pulse width $\tau_o$.

In accordance with the present invention, the effect of pulse width modulation is simulated by altering the subset of stored harmonic coefficients $C_m$ that are used in the waveshape amplitude computation. This is accomplished by adding a harmonic coefficient subset selection factor $p$ to the value $n$ which designates the order of the harmonic coefficient presently being evaluated. The sum $m=n+p$ then designates which harmonic coefficient $C_m$ is to be accessed from the memory 101 for use in the Fourier component evaluation.

This is implemented by the adder 104 which adds the value $p$ supplied on the line 106 to the value $n$ present on the line 103. The sum $m=n+p$ is supplied via the line 105 to the memory access control 102. Accordingly, the corresponding harmonic coefficient $C_m$ is accessed from the memory 101.

By way of example, if $p=1$, during calculation of the first order ($n=1$) Fourier component, the harmonic coefficient $C_m32$ $C_2$ will be supplied from the memory 101 to the harmonic amplitude multiplier 33. Similarly, during evaluation of each of the higher order Fourier components, the harmonic coefficient $C_m=C_{n+1}$ will be used to establish the amplitude of that component. As a result, the evaluated Fourier components will correspond in amplitude to the subset indicated by the bracket $p=1$ in FIG. 2. Of significance is the fact that the null or zero-point now occurs at the 15th harmonic, instead of at the 16th. Comparison with FIG. 3 shows that such a spectrum is associated with a pulse train wherein each pulse has a width $\tau$ greater than $\tau_o$. In other words, the tone generated by the computor organ 10 for the value $p=1$ will simulate that of an analog instrument producing pulses each having a width greater than that of FIG. 1.

If the value $p=2$ is supplied on the line 106 to the adder 104, the harmonic coefficients $C_m=C_{n+2}$ will be used in the Fourier component evaluation. Correspondingly, Fourier components of the subset designated by the bracket $p=2$ in FIG. 2 will be produced. This spectrum corresponds to that of a pulse train like FIG. 1, but of even greater pulse width than for the case of $p=1$.

Thus pulse width modulation effects can be produced by the computor organ 10 by modifying the value $p$ supplied to the adder 104. Time variant pulse width modulation effects are achieved by altering the value $p$ as a function of time. For example, if $p$ is varied periodically at a rate of between about 5Hz and 8Hz, a pulse width modulation effect similar to vibrato will be produced.

Such periodic variation of the factor $p$ is implemented by the circuitry 100. The rate of variation is established by a clock 111 and its associated rate control circuit 112. Pulses from the clock 111 are used to increment or decrement a counter 113 the contents of which, supplied on the line 106, represent the value $p$.

The extent of pulse width variation is established by setting minimum and maximum values $p_{min}$ and $p_{max}$ for the factor $p$. Thus a circuit 114 provides a selected value $p_{min}$ on a line 115 and a circuit 116 provides the selected value $p_{max}$ on a line 117. Advantageously, but not necessarily, $p_{min}=0$. The circuits 114 and 116 may be hard wired to provide preset values of $p_{min}$ and $p_{max}$ continuously, or they may comprise switches permitting operator selection of these values. For example, the circuit 114 may continuously provide the value "0" on the line 115, while the circuit 116 may comprise a switch that permits the musician to set $p_{max}$ and hence to select the effective change in pulse width that will occur at the rate established by the control circuit 112.

Normally the counter 113 will be incremented by each pulse from the clock 111. When the contents $p$ of the counter 113 equals $p_{max}$, both inputs to a comparator 118 will be equal. The resultant output signal from the comparator 118 will set a flip-flop 119 to the "1" state. This will produce a high or "1" signal on a line 120 to the "increment/decrement" input of the counter 113. When this input is high, the counter will be decremented by each pulse from the clock 111. Thus, after the counter 113 reaches a count of $p=p_{max}$, the counter will reverse direction so that the successive values of $p$ supplied on the line 106 will decrease in value.

When the counter 113 contents reach $p_{min}$, both inputs to a comparator 121 will be equal. The resultant output signal from the comparator 121 will reset the flip-flop 119 to the "0" state, thereby providing a low signal on the line 120 which switches the counter 113 to the increment mode. Once again the counter 113 provides increasing values of $p$ on the line 106.

The foregoing operation occurs repetitively, so as to provide periodically varying factors $p$ on the line 106 at a rate established by the clock 111. In the manner described above, this causes a periodic variation of the subsets of harmonic coefficients $C_m$ supplied from the memory 101 to the harmonic amplitude multiplier 33. As a result, the tonal quality of the notes generated by the computor organ 10 will be characteristic of a pulse width modulation at a rate established by the clock 111.

Figure 2:
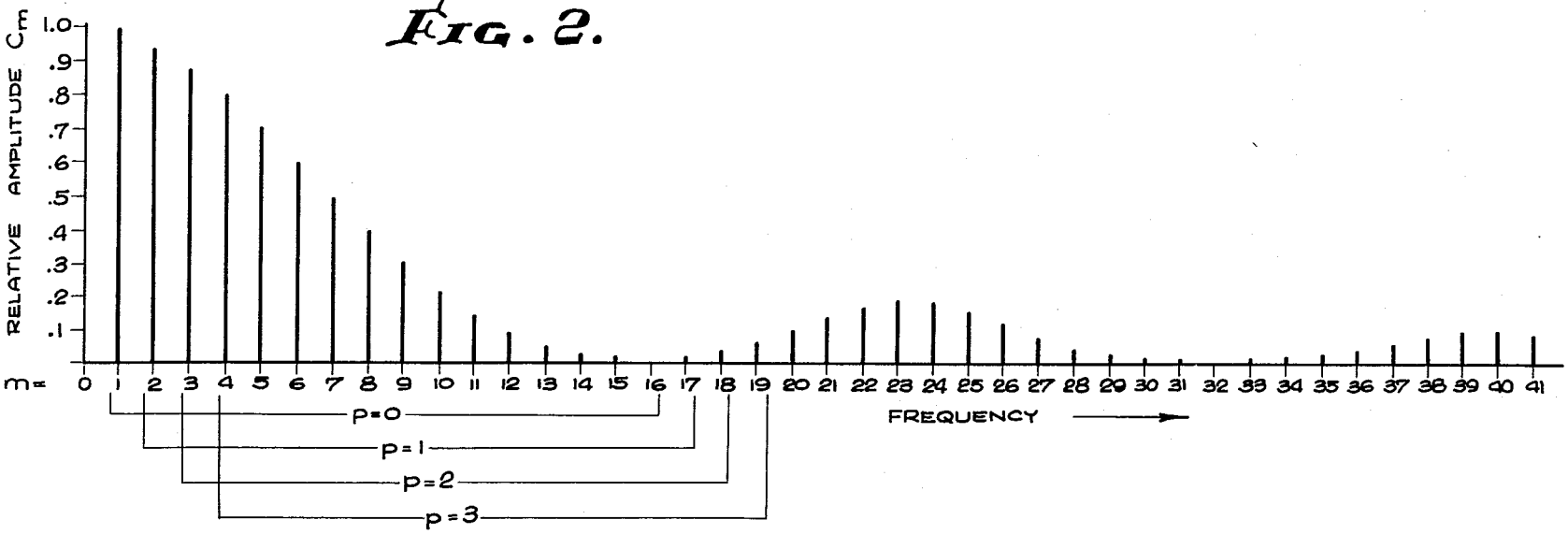
FIG. 2 is a typical harmonic spectrum associated with the rectangular pulse train of FIG. 1.
Figure 3:
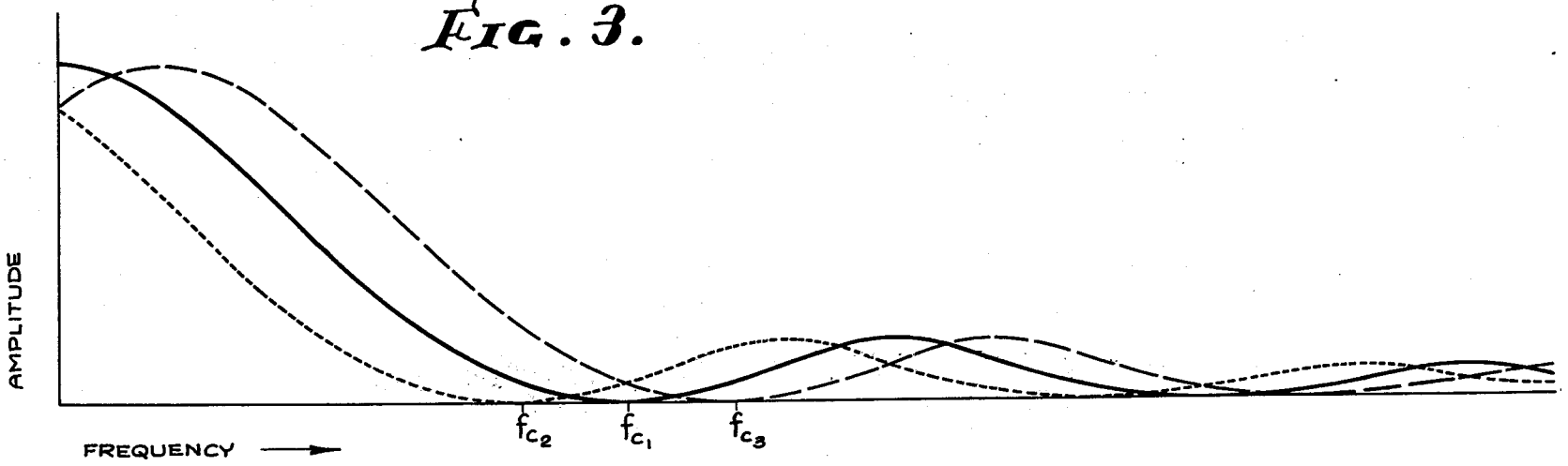
FIG. 3 is a graph of the amplitude envelopes of several spectra associated with rectangular pulse trains of the same frequency but different pulse widths.

Observe in FIG. 2 that when $p=1$, the lowest order Fourier component 121 evaluated by the computor organ 10 may be lower in amplitude than the lowest order component 122 which is evaluated when $p=0$. Similarly, when $p=2$, the lowest order Fourier component 123 may be lower yet in amplitude. As a result, the generated tone may exhibit an amplitude modulation at the same rate at which $p$ is varied. If desired, this amplitude variation can be minimized or eliminated by compensating circuitry that is put into operation by connecting the switch 108 to the contact 108*b*.

To provide amplitude compensation, a set of compensating scale factors $s(m)$ are stored in a memory 125. These are accessed by a control circuit 126 which also receives the value $m=n+p$ from the line 105. As each value $C_m$ is accessed from the memory 101, the corresponding scale factor $s(m)$ is provided from the memory 125 via a line 127 to a scaler 128. This scaler 128 multiplies the value $C_m$ on the line 107 by the supplied value $s(m)$ and provides the product $s(m)C_m$ via the line 109 to the harmonic amplitude multiplier 33. As a result, the scaled harmonic coefficient is used by the computor organ 10 to establish the Fourier component amplitude instead of the coefficient $C_m$ itself.

Advantageously the scale factors $s(m)$ stored in the memory 125 are given by:

$s(m) = C_1/C_m$ (Equation 4)

so that the lowest order Fourier component evaluated by the computor organ 10 always will have the same amplitude as the lowest order ($n=1$) component that is generated when $p=0$. However, the invention is not so limited, and other values of $s(m)$ may be employed. The scale factor memory 125 and its associated control circuit 126 both may be implemented using a conventional integrated circuit read-only memory such as the Signetics type SIG 8223.

Figure 5:
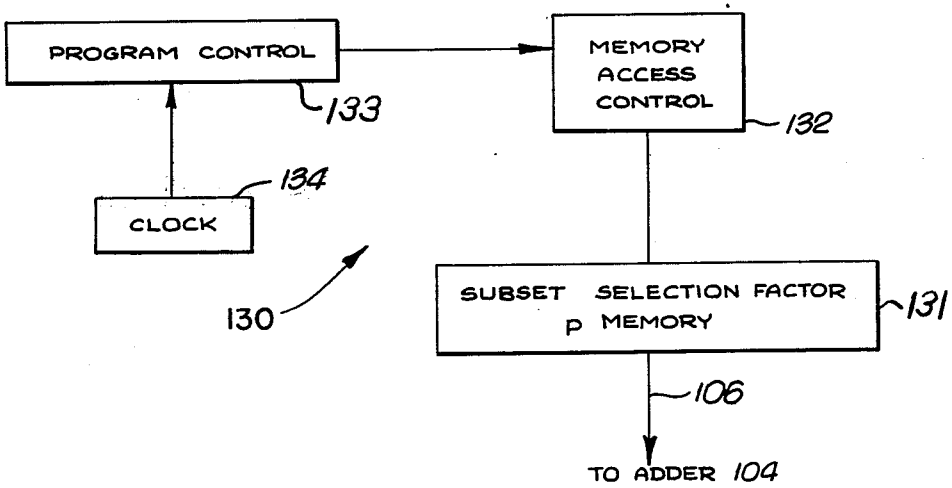
FIG. 5 is a partial block diagram of alternative circuitry for producing pulse width modulation effects.

The present invention is by no means limited to periodic variation of the factor $p$. These factors $p$ may vary in any fashion to produce unusual pulse width modulation tonal effects. Instead of using the counter 113 to provide values of $p$, such values may be supplied to the adder 104 by the alternative circuitry 130 of FIG. 5. Here a set of factors $p$ of any desired, arbitrary value is stored in a memory 131. They are accessed in a predetermined, or possibly random, order by a memory access circuit 132 in cooperation with a program control 133. A clock 134 cooperates with the program control 133 to establish the pulse width modulation rate.

Nor is the invention limited to the set of harmonic coefficients $C_m$ listed in table I above and associated with a rectangular pulse train. Pulses of other shape may be synthesized by using other sets of harmonic coefficient $C_m$ values. For example, a first order $J_o(m)$ Bessel function may be used to establish the harmonic coefficient values. The following table III lists illustrative $C_m$ values for the Bessel function $J_o$ (2.41m/16).

TABLE II

| m | $C_m$ | db Attenuation | m | $C_m$ | db Attenuation |
|---|---|---|---|---|---|
| 1 | 1.0000 | 0 | 17 | 0.0785 | 22.10 |
| 2 | 0.9840 | 0.14 | 18 | 0.1483 | 16.58 |
| 3 | 0.9561 | 0.39 | 19 | 0.2111 | 13.51 |
| 4 | 0.9173 | 0.75 | 20 | 0.2658 | 11.51 |
| 5 | 0.8690 | 1.22 | 21 | 0.3122 | 10.11 |
| 6 | 0.8110 | 1.82 | 22 | 0.3495 | 9.13 |
| 7 | 0.7456 | 2.55 | 23 | 0.3771 | 8.47 |
| 8 | 0.6730 | 3.44 | 24 | 0.3958 | 8.05 |
| 9 | 0.5943 | 4.52 | 25 | 0.4046 | 7.86 |
| 10 | 0.5117 | 5.82 | 26 | 0.4036 | 7.88 |
| 11 | 0.4256 | 7.42 | 27 | 0.3945 | 8.08 |
| 12 | 0.3777 | 9.43 | 28 | 0.3763 | 8.49 |
| 13 | 0.2497 | 12.05 | 29 | 0.3508 | 9.10 |
| 14 | 0.1627 | 15.77 | 30 | 0.3181 | 9.95 |
| 15 | 0.0781 | 22.15 | 31 | 0.2796 | 11.07 |
| 16 | 0.0027 | 51.37 | 32 | 0.2358 | 12.55 |

From the foregoing table II, it is apparent that the minima of the generated spectrum are not periodic. This results since the pulse shape that is simulated is not rectangular, but rather is of curved, Bessel function shape.

Various components utilized herein are available as commercial integrated circuits. For example, the comparators 118 and 121 each may comprise one or more Texas Instruments type SN54L85 or SN74L85 four-bit magnitude comparators. The scaler 128 may comprise a Signetics type SIG 8243 scaler or may be implemented using Signetics type SIG 8202 buffer registers and a SIG 8260 arithmetic element as shown in the application sheet, page 28, of the Signetics 1971 catalog entitled "Digital 8000 Series TTL/MSI". The memory 131 and its associated access control 132 may be implemented using a Signetics type SIG 8223 or a Texas Instrument type SN 5488A or SN7488A read-only memory. Circuitry for the program control 133 is arbitrary, but may simply comprise a counter such as the Signetics type SIG 8281 that counts pulses from the clock 134 and provides a binary address to the address control portion of the read only memory used to implement blocks 131 and 132.

Intending to claim all novel, useful and obvious features shown or described, the applicant claims:

1. In an electronic musical instrument of the type including generation means wherein musical tones are generated by computing in real time the amplitudes at successive sample points of that waveshape, said waveshape amplitudes being converted to musical tones as the computations are carried out, said generation means including calculation circuitry for separately calculating the constituent Fourier components of a musical waveshape, and an accumulator for summing these components to obtain each waveshape sample point amplitude, and wherein the relative amplitude of each constituent Fourier component with respect to each other is established by a harmonic coefficient associated with the order of that component, the improvement for simulating the tonal quality of a repetitive pulse train having a particular pulse shape comprising;

coefficient supply means for providing a set of harmonic coefficient values that define the frequency spectrum of said pulse train of particular pulse shape, and control means, connected to said coefficient supply means and to said generation means, for causing said supply means to provide a certain subset of said coefficient values to said calculation circuitry to establish said Fourier component relative amplitudes.

2. An electronic musical instrument according to claim 1 including the further improvement for simulating pulse width modulation tonal effects, wherein;

said supply means comprises a storage device storing a set of harmonic coefficients $C_m$ including more coefficients than the maximum number of Fourier components included in each waveshape amplitude summation, wherein $C_m$ is the relative amplitude of the $m^{th}$ order Fourier component, and further comprising:

time varying subset selection means, connected to said control means, for causing access from said storage device of different subsets of said harmonic coefficients $C_m$ at different times.

3. An electronic musical instrument according to claim 2 wherein said stored set includes harmonic coefficients $C_m$ extending to an order that is greater than the highest order Fourier component included by said accumulator in each waveshape summation, and wherein said subset selection means includes;

circuitry providing a time varying subset selection factor $p$, and wherein said access control means includes;

an order indicating circuit, connected to said calculation circuitry, for providing a signal $n$ indicating the order $n$ of the Fourier component currently being calculated by said calculation circuitry, and an adder for summing the selection factor $p$ from said circuitry and the order signal $n$ from said indicating circuit to obtain the sum $m=p+n$, said control means accessing from said storage device the coefficient $C_m$ corresponding to said sum $m=p+n$.

4. An electronic musical instrument according to claim 3 wherein said circuitry includes a clock and means for causing said factor $p$ to vary periodically at a rate established by said clock.

5. An electronic musical instrument according to claim 2 wherein said particular pulse shape is rectangular and each pulse has a width $\tau$ and an amplitude A, the pulse repetition period being T, and wherein the set of stored harmonic coefficients $C_m$ is given by $$C_m = A \frac{\tau}{T} \frac{\sin \pi m(\tau/T)}{\pi m(\tau/T)}$$

where $m=1, 2, 3, \ldots$ is the order of the coefficient $C_m$.

6. An electronic musical instrument according to claim 1 wherein said particular pulse shape is rectangular, and wherein said set of coefficients corresponds to the Fourier coefficients associated with the Fourier transform of a rectangular pulse train.

7. An electronic musical instrument according to claim 1 wherein said set of coefficients corresponds to a Bessel function.

8. In an electronic musical instrument of the type including generation means wherein musical tones are generated by computing in real time the amplitudes at successive sample points of that waveshape, said waveshape amplitudes being converted to musical tones as the computations are carried out, said generation means including calculation circuitry for separately calculating the constituent Fourier components of a musical waveshape, and an accumulator for summing these components to obtain each waveshape sample point amplitude, and wherein the relative amplitude of each constituent Fourier component is established by a harmonic coefficient associated with the order n of that component, the improvement for simulating pulse width modulation tonal effects, comprising;

a memory storing a set of harmonic coefficients $C_m$ that define the relative amplitudes of the components in the frequency spectrum of a pulse train of particular pulse shape, where $m$ designates the order in that spectrum, said set including a number of coefficients $C_m$ for components of order greater than the highest order $n_{max}$ Fourier component included by said accumulator in each waveshape amplitude summation, subset selection circuitry for providing a time varying factor $p$ that established the subset of harmonic coefficients $C_m$ to be utilized by said calculation circuitry, order designating means, connected to said calculation circuitry, for providing a signal $n$ that indicates the order $n$ of the Fourier component currently being calculated by said calculation circuitry, an adder for summing the factor $p$ from said selection circuitry and the signal $n$ from said designating means to obtain the value $m=p+n$, and a memory access control for accessing from said memory the harmonic coefficient $C_m$ corresponding to the value $m=p+n$ obtained by said adder, said instrument utilizing this accessed coefficient $C_m = C_{(p+n)}$ to establish the relative amplitude of the $n^{th}$ order Fourier component currently being calculated.

9. An electronic musical instrument according to claim 8 wherein said particular pulse shape is rectangular and wherein said coefficients $C_m$ are given by:

$$C_m = A \frac{\tau}{T} \frac{\sin \pi m(\tau/T)}{\pi m(\tau/T)}$$

where $\tau$ is the pulse width, $T$ is the pulse repetition period, and $A$ is the pulse amplitude, and wherein said set includes values of $C_m$ between $C_l$ and $C_{m_{max}}$ where $m_{max}>W$, and wherein said factor $p$ has only integral values.

10. An electronic musical instrument according to claim 9 wherein said subset selection circuitry includes, a clock of controllable clock rate, and means for periodically varying the factor $p$ at a rate established by said clock, the resultant musical tones exhibiting the tonal quality of a periodically pulse-width modulated pulse train.

11. An electronic musical instrument according to claim 8 wherein said subset selection circuitry includes;

a clock, and means for programmatically varying the factor $p$ at a rate established by said clock.

* * * * *